US005628079A

United States Patent [19]

Kizemchuk et al.

[11] Patent Number: 5,628,079

[45] Date of Patent: May 13, 1997

[54] SEAT CUSHION WITH PROJECTIONS

[76] Inventors: Hanya Kizemchuk; Herold Fensterer, both of 60 Montclair Avenue #701, Toronto, Ontario, Canada, J5P 1P7

[21] Appl. No.: 585,663

[22] Filed: Jan. 16, 1996

[51] Int. Cl.[6] ..... A47C 7/18

[52] U.S. Cl. ..... 5/653; 5/944; 297/183.5; 297/219.1; 601/134

[58] Field of Search ..... 5/653, 654, 448, 5/468, 465, 900.5, 462, 657, 420, 944, 652.1, 722, 724, 730, 731, 736; 297/219.1, 183.5; 601/134, 136

[56] References Cited

U.S. PATENT DOCUMENTS

| | | | |
|---|---|---|---|
| D. 332,546 | 1/1993 | Waltner | 5/653 |
| 2,156,629 | 5/1939 | Hutchinson | 5/653 |
| 2,618,790 | 11/1952 | Ritchey | 5/653 |
| 3,100,483 | 8/1963 | Altmeyer et al. . | |
| 3,885,555 | 5/1975 | Nobbs . | |
| 4,744,351 | 5/1988 | Grundei et al. | 55/900.5 |
| 5,153,956 | 10/1992 | Nold | 5/900.5 |
| 5,158,073 | 10/1992 | Bukowski . | |
| 5,402,545 | 4/1995 | Jolley | 5/653 |

FOREIGN PATENT DOCUMENTS

| | | | |
|---|---|---|---|
| 452599 | 11/1948 | Canada . | |
| 1248294 | 1/1989 | Canada . | |
| 1257934 | 7/1989 | Canada . | |
| 3905072 | 8/1990 | Germany | 297/219.1 |
| 921098 | 3/1963 | United Kingdom | 5/900.5 |

*Primary Examiner*—Alexander Grosz
*Attorney, Agent, or Firm*—Duft, Graziano, & Forest, P.C.

[57] ABSTRACT

A seat cushion having a flexible substrate and pads. The flexible substrate has first and second pads in a spaced-apart relationship, forming a hinge of the substrate therebetween. The flexible substrate may be moved from an open lay-flat position to a closed position in which said pads are in a face-to-face relationship. The pads are formed of a comfort-compressible rubber composition and have a pattern of projections thereon in a spaced-apart relationship. The pattern includes a concentric array of projections extending substantially across the width of each of such pads. The rubber composition has a non-porous surface, and the flexible substrate and pads are washable. The seat cushion is particularly useful in saunas and steam baths.

9 Claims, 2 Drawing Sheets

SEAT CUSHION WITH PROJECTIONS

FIELD OF THE INVENTION

The present invention relates to a portable seat cushion and in particular to a portable seat cushion that is washable and intended for a wide variety of uses, for example in offices, vehicles, on the ground and on other surfaces used for sitting, but especially intended for use in steam rooms, saunas or the like. The seat cushion has a plurality of projections, including projections in a circular pattern that provide comfort and massage, or other benefits.

BACKGROUND OF THE INVENTION

As part of the trend towards a better lifestyle, many people visit saunas and steam rooms, after exercising or at other time merely to obtain the benefits of the sauna or steam room. It is common practise for the person using the sauna or steam room to sit naked on a wooden or ceramic bench, and concerns have been expressed with respect to the hygiene of doing so. As people become more and more concerned about transmittal of diseases, especially sexually-related diseases, they become more concerned about the hygiene aspects of the use of saunas. While operators of saunas may take significant steps to cleanse the wooden benches on which people sit and to maintain hygienic conditions, such concerns remain. A person may take a towel or other object into the sauna in order to protect themselves, but this is frequently not a practical solution to concerns on hygiene.

In addition to such concerns, it would be useful if the person could sit on a surface that provided both comfort and some beneficial effects, including, massaging effects, e.g. relating to so-called "cellulite" that might be present on a person's upper thighs and/or their buttocks.

SUMMARY OF THE INVENTION

A seat cushion has now been found which is portable and washable, so that it may be maintained in a clean and hygienic condition, and which provides comfort and other benefits to a person using the cushion.

Accordingly, one aspect of the present invention provides a seat cushion comprising:

(a) a flexible substrate having a first pad and a second pad thereon, said first and second pad being in a spaced-apart generally parallel relationship, forming a hinge of said substrate therebetween such that the flexible substrate may be moved from an open lay-flat position to a closed position in which said pads are in a face-to-face relationship; and (b) said pads being formed of a compressible rubber composition and having a pattern of projections thereon in a spaced-apart relationship, said pattern including a concentric array of such projections extending substantially across the width of each of such pads the height of the projections of the concentric arrays increasing from the center of the arrays toward the peripheries of the arrays, the concentric arrays adapted to support the buttocks of a user.

In a preferred embodiment of the invention, the pads are elongated with the concentric array of projections being off-set with respect to the length of the pads.

In a further embodiment, the flexible substrate and pads are integrally connected, especially in which the flexible substrate and pads are both formed from the comfort-compressible rubber composition.

In another embodiment, the flexible substrate has handles thereon on opposed edges.

BRIEF DESCRIPTION OF THE DRAWINGS

The present invention is illustrated by the embodiments shown in the drawings in which.

DETAILED DESCRIPTION OF THE INVENTION

Figure 1:
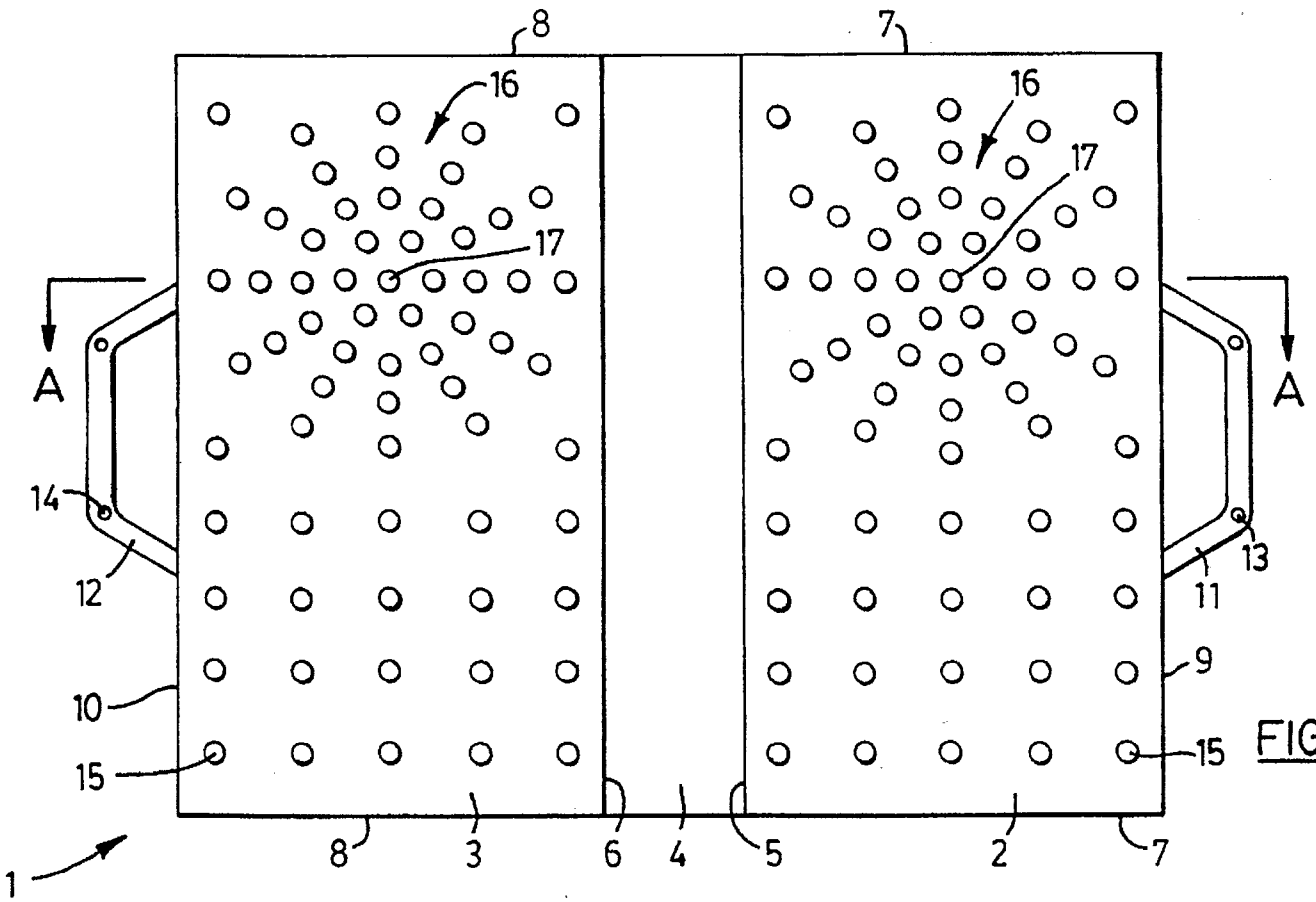
FIG. 1 is a schematic representation of a plan view of the seat cushion in an open position.

FIG. 1 shows a seat cushion generally indicated by 1, which has a first pad 2 and a second pad 3. First pad 2 and second pad 3 are attached to a substrate, which is generally not shown in FIG. 1 apart from at hinge 4. First pad 2 has a linear inner edge 5 and similarly second pad 3 has a linear inner edge 6. Linear edges 5 and 6 are preferred so that seat cushion 1 may be folded to a closed position in a convenient manner. Thus, it is preferred that first pad 2 and second pad 3 be in a parallel aligned relationship with linear adjacent edges when in an open position, but it is understood that the adjacent edges may be other than linear, provided that seat cushion may be folded and unfolded.

End edges 7 of first pad 2 and end edges 8 of second pad 3 are shown in FIG. 1 as being straight edges, meeting outside edge 9 of pad 2 and outside edge 10 of pad 3 with square corners. However, end edges 7 and 8 do not need to be linear, and even if so do not need to meet outer edges 9 and 10 with square corners. In a particular embodiment, the corners are rounded.

Outer edge 9 is shown as having handle 11 attached thereto and similarly outer edge 10 is shown as having handle 12 attached thereto. Handles 11 and 12 are positioned in a cooperative relationship, as will be understood. In the embodiment shown, handle 11 has projections 13 thereon, which are intended to mate with orifices 14 on handle 12 when the seat cushion is in a closed position.

Pads 2 and 3 have projections 15 thereon. In the embodiment shown in the drawings, each of pad 2 and pad 3 has five rows of projections 15. However, it is to be understood that the embodiment has been shown with five rows for clarity, and that normally the seat cushion would have more than five rows, and especially more than ten rows and preferably 10–20 rows. The spacing between projections 15 is primarily governed by comfort to the user. However, the spacing between adjacent projections should not be more than 2.5 cm, especially not more than 2.0 cm and especially in the range of 0.7–1.5 cm. Similarly, the height and shape of the projection is governed by convenience and comfort to the user. For instance, the projections should be of a height, and in a spaced-apart relationship, sufficient to allow water e.g. sweat, moisture or the like, to flow from the seat cushion when in use without discomfort to the user, when the seat cushion is being used in a sauna, steam room or the like. The projections should be of a shape that is both comfortable and will provide adequate support to the user. For instance, the projections would normally be conical and have rounded peaks, rather than being needle-like.

The projections generally indicated by 16 are not in an aligned relationship, in contrast to projections 15, but are in a circular concentric array. The projection at the center of the array is projection 17 on each of first pad 2 and second pad 3. As illustrated, the concentric array extends from the central projection 17 to the edges of each of first pad 2 and second pad 3. The center of the concentric array of projections is particularly intended to correspond to the location of the socket where the femur of the user is attached to their pelvis.

Figure 2:
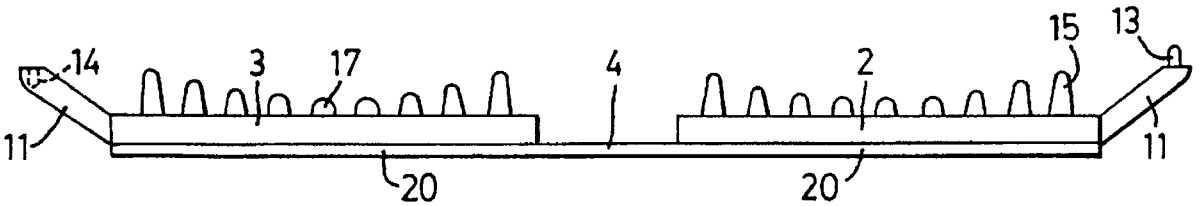
FIG. 2 is a schematic representation of a section of the seat cushion taken through A—A of FIG. 1.

FIG. 2 shows a cross section through A—A of FIG. 1. First pad 2 and second pad 3 are shown as separated by hinge 4. Hinge 4 is formed by substrate 20 which extends from first pad 2 through hinge 4 and second pad 3. Projections 15 are shown as being integrally formed as part of each of first pad 2 and second pad 3. It will be noted that the cross section shown in FIG. 2 shows that the projections 15 vary in height across the seat cushion. In particular, the projections have a height in the center of the pad, corresponding to the centre of the concentric array of projections, that are shorter than projections in other locations. The height of the projections increases as the distance from the centre of the array increases i.e. as the projections approach the edges of first pad 2 and second pad 3. For instance, the projections away from the low central projection may be 2–3 times higher than the central projection.

Figure 3:
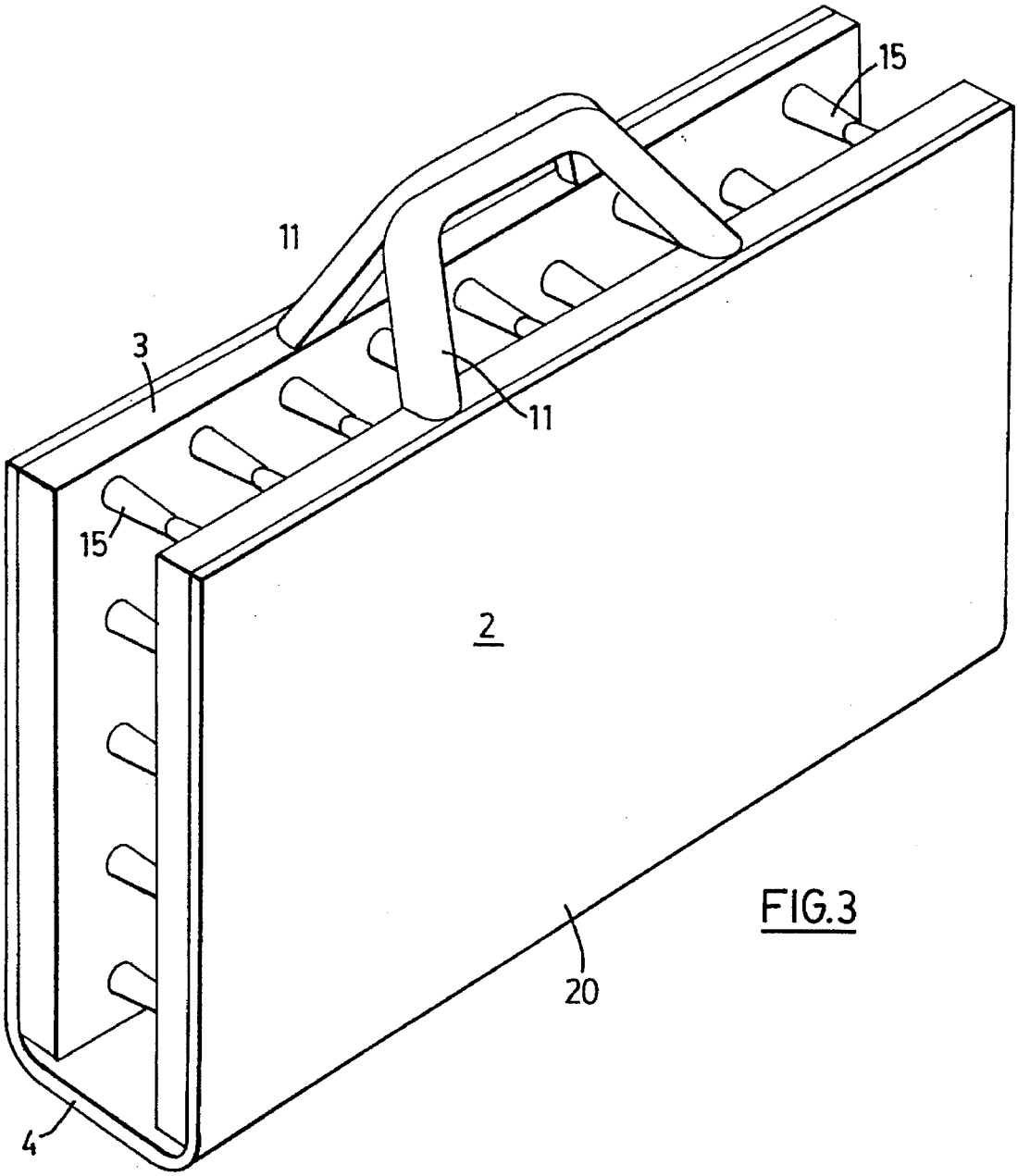
FIG. 3 is a schematic representation of a perspective view of a seat cushion in a closed position.

FIG. 3 shows the seat cushion in a closed position. First pad 2 and second pad 3 are shown in a face-to-face relationship, with projections 15 (or 16, 17) between them. Substrate 20 extends across the surface of the first pad 2 through hinge 4 and across the surface of second pad 3, the latter not being shown. Handles 11 and 12 are shown in a juxtaposed position.

First pad 2 and second pad 3, and the associated projections 15, 16 and 17 are formed from a rubber composition. The rubber composition needs to have a washable surface, i.e. it needs to have a continuous surface layer referred to herein as a non-porous surface, such that it may be readily cleaned. In addition, the rubber composition needs to have a degree of compressibility such that the projections 15, 16 and 17 are comfortable to sit on, referred to herein as comfort-compressible rubber composition. Likewise, projections 15, 16 and 17 are of a size and shape suitable for sitting on, as discussed above. Substrate 20 will normally be formed of the same composition as the pads and integrally formed therewith. Alternatively, the substrate and pads are different materials. If so, the rubber composition of first pad 2 and second pad 3 and the fabric of substrate 4 are chosen such that during manufacture, good adhesion is achieved between the pads and the rubber composition so that the cushion will retain its integrity. If the substrate is not formed from the same composition as the pads, it must be of a material that is readily washable to provide a hygienic surface. Moreover, the substrate should not have a surface that has nooks and crannies where bacteria or the like might accumulate. Fabric surfaces are prone to accumulation of bacteria.

Handles 11 and 12 would normally be formed as part of first pad 2 and second pad 3 during manufacture i.e. the handles would be integrally attached to the respective pads, and formed therewith during manufacture.

In preferred embodiments, the pad, substrate and handles are formed integrally from the rubber composition.

The present invention provides a multi-functional multi-purpose seat cushion that provides comfort and/or massage to the user. While emphasis has been placed herein on the use of the seat cushion in a sauna, steam room or the like, to provide comfort, massage and hygienic protection to a user, it is understood that the seat cushion may be used in other locations. For instance, the seat cushion may be used by secretaries, other office personnel, in automobiles, trucks and other vehicles, particularly by the driver.

The seat cushion is particularly intended for use in health clubs e.g. in steam rooms, saunas or the like, to elevate and separate a person's buttocks from the surface of a wooden or ceramic seat, which may be contaminated. Such use is of particular importance in the current era of sexually transmitted diseases. In addition to providing hygienic protection, the seat cushion provides comfort and in particular massage of a persons buttocks or thighs e.g. to help alleviate cellulite. The conical shape of the projections and the pattern of projections, including the height of the projections, described herein are believed to help in comfort, massage and breakdown of cellulite.

Other uses could include use on a beach, to minimize the sand that would contact a bathing suit, in bathtubs or the like.

The seat cushion is practical, as it may be folded and transported readily to other locations, and readily cleaned. The handles make the seat cushion easy to transport and to store e.g. by being hung up on a hook.

The present invention is illustrated by the following example:

EXAMPLE 1

A seat cushion as described herein was fabricated using a comfort compressible rubber composition. The two pads had their inner edges in a separated but aligned position. The rubber composition provided the projections with both comfort to a user and support such that moisture could run off the user and flow from the cushion, while still separating the person from a bench.

The shortest projection, at the centre of the array of projections, had a height of about 0.6 cm. The height of the projections increased as the distance across the array increased such that the projections towards the edge of the array were about 1.2 cm in height. Projections located further from the centre of the array had a height of approximately 2 cm.

The seat cushion was comfortable to sit on, was portable, provided massage and functioned to let moisture run off the user's body.

We claim:

1. A seat cushion adapted to support the buttocks and thighs of a seated user comprising:

a flexible substrate having a first pad and a second pad thereon, said first and second pad being in a spaced-apart generally parallel relationship, forming a hinge of said substrate therebetween such that the flexible substrate may be moved from an open lay-flat position to a closed position in which said pads are in a face-to-face relationship; said pads being formed of a compressible rubber composition and having a pattern of projections thereon in a spaced-apart relationship, said pattern including a concentric array of such projections extending substantially across the width of each of such pads, the height of the projections of the concentric arrays increasing from the center of the arrays toward the peripheries of the arrays, the concentric arrays adapted to support the buttocks of a user.

2. The seat cushion of claim 1 in which the pads are elongated with the concentric array of projections being off-set with respect to the length of the pads.

3. The seat cushion of claim 1 in which the flexible substrate has handles thereon on opposed edges.

4. The seat cushion of claim 1 in which the flexible substrate and pads are integrally connected.

5. The seat cushion of claim 4 in which the flexible substrate and pads are both formed from the compressible rubber composition.

6. The seat cushion of claim 1 in which the first and second pads are aligned.

7. The seat cushion of claim 6 in which the first and second pads are aligned with linear adjacent edges.

8. The seat cushion of claim 1, in which said rubber composition has a non-porous surface.

9. The seat cushion of claim 1, in which said flexible substrate and said pads are washable.

* * * * *